US008607772B2

(12) United States Patent
Barnett

(10) Patent No.: US 8,607,772 B2
(45) Date of Patent: Dec. 17, 2013

(54) CROSSBOW STOCK WITH IMPROVED TRACK ASSEMBLY AND METHOD

(75) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 179 days.

(21) Appl. No.: 13/335,163

(22) Filed: Dec. 22, 2011

(65) Prior Publication Data

US 2012/0192842 A1 Aug. 2, 2012

Related U.S. Application Data

(60) Provisional application No. 61/436,853, filed on Jan. 27, 2011.

(51) Int. Cl.
*F41B 5/12* (2006.01)

(52) U.S. Cl.
USPC ..... 124/25

(58) Field of Classification Search
USPC ..... 124/25
See application file for complete search history.

(56) References Cited

U.S. PATENT DOCUMENTS

| | | | | |
|---|---|---|---|---|
| 4,696,281 | A | 9/1987 | Nishioka | |
| 4,827,893 | A * | 5/1989 | Nishioka | 124/25 |
| 4,860,719 | A | 8/1989 | Scheiterlein | |
| 5,062,406 | A * | 11/1991 | Robertson | 124/25 |
| 5,119,797 | A * | 6/1992 | Anderson | 124/25 |
| 5,630,405 | A * | 5/1997 | Nizov | 124/25 |
| 7,007,445 | B2 | 3/2006 | Louviere | |

* cited by examiner

*Primary Examiner* — John Ricci
(74) *Attorney, Agent, or Firm* — Jones Walker LLP

(57) ABSTRACT

A flight track assembly of a crossbow stock having a base component dimensioned to attach to an upper portion of the crossbow stock and a flight track component disposed on an upper surface of the base component. The flight track component is formed by one continuous piece or two rails. The flight track component is secured to the base component by an attachment mechanism. For example, the attachment mechanism is a projection extending from a lower surface of the flight track component designed to slide into a recess in the upper surface of the base component. Alternatively, the attachment mechanism is a projection extending from the lower surface of the flight track component designed to engage a cooperating projection on the upper surface of the base component.

28 Claims, 7 Drawing Sheets

CROSSBOW STOCK WITH IMPROVED TRACK ASSEMBLY AND METHOD

CROSS-REFERENCE TO RELATED APPLICATIONS

This application claims priority to U.S. Provisional Patent Application No. 61/436,853, filed on Jan. 27, 2011, which is incorporated herein by reference.

SUMMARY OF SELECTED EMBODIMENTS OF THE INVENTION

A flight track assembly of a crossbow stock. The flight track assembly may include a base component dimensioned to attach to an upper portion of the crossbow stock. The flight track assembly may also include a flight track component disposed on an upper surface of the base component. The flight track component may be secured to the base component by an attachment mechanism.

The flight track component may include one continuous piece. Alternatively, the flight track component may include two rails.

The attachment mechanism may include a projection extending from a lower surface of the flight track component and a reciprocally shaped recess in the upper surface of the base component. The projection may be designed to slide into the recess to secure the flight track component to the base component.

Alternatively, the attachment mechanism may include a projection extending from a lower surface of the flight track component and a cooperating projection on the upper surface of the base component. The projection may be designed to engage the cooperating projection to secure the flight track component to the base component. The projection may include an L-shaped or C-shaped projection.

In another alternative, the attachment mechanism may include a series of recesses through the flight track component. The series of recesses may be designed to attach the flight track component to the base component during a molding process in which the base component is formed by allowing a portion of a material forming the base component to overlap a portion of the flight track component.

The base component may be formed of a plastic material, a composite material, or a carbon material. Alternatively, a portion of the base component may include aluminum. The base component may be formed by a molding process. The flight track component may be formed of aluminum, stainless steel, another metal, a ceramic material, or a composite material. The flight track component may be formed by extrusion, die-stamping, or pultrusion. Alternatively, the flight track component may be formed of a material capable of being molded, and the flight track component may be formed by a molding process. An upper surface of the flight track component may be formed of a low friction material.

A crossbow including a crossbow stock and a flight track component. The crossbow stock may include an upper portion. The flight track component may include a base component and a flight track component. The base component may include a base component operatively connected to said upper portion of the crossbow stock. The flight track component may be disposed on an upper surface of the base component. The flight track component may be secured to the base component by an attachment mechanism.

The attachment mechanism may include a projection extending from a lower surface of the flight track component and a reciprocally shaped recess in the upper surface of the base component. The projection may be designed to slide into the recess to secure the flight track component to the base component.

Alternatively, the attachment mechanism may include a projection extending from a lower surface of the flight track component and a cooperating projection on the upper surface of the base component. The projection may be designed to engage the cooperating projection to secure the flight track component to the base component.

In another alternative, the attachment mechanism may include a series of recesses through the flight track component. The series of recesses may be designed to attach the flight track component to the base component during a molding process in which the base component is formed by allowing a portion of a material forming the base component to overlap a portion of the flight track component.

A method of making a crossbow stock may include forming a crossbow stock by a molding process, attaching a base component of a flight track assembly to an upper portion of the crossbow stock, and attaching a flight track component of the flight track assembly to an upper surface of the base component. The base component may be attached to the crossbow stock by sealing, gluing, or mechanically attaching. The base component may be mechanically attached to the crossbow stock with a screw, a pin, or a bolt. Alternatively, the base component may include a profile that slidingly engages with a mating profile in the upper portion of the crossbow stock, and the base component may be attached to the crossbow stock by sliding the base component into the upper portion of the crossbow stock.

In another alternative, the base component may be formed as an extension on the upper portion of the crossbow stock by the molding process in which the crossbow stock is formed. The flight track component may be attached to the upper surface of the base component during the molding process. Before the molding process, the flight track component may be secured to a portion of a mold assembly used in the molding process. The flight track component may be secured to the portion of the mold assembly by a series of magnets fixed to the flight track component. Alternatively, the flight track component may be secured to the portion of the mold assembly by a vacuum. In one embodiment, the flight track component may be formed of a plastic or polymer material.

DETAILED DESCRIPTION OF THE PREFERRED EMBODIMENTS

A track or barrel of a crossbow is positioned on the upper surface of a crossbow stock between a handle or trigger area and the forward most part of the crossbow stock. The track is designed to provide a surface for the bow string as it is released from the trigger mechanism and moves forward to eject the crossbow arrow, which is also positioned on top of or supported by the upper surface of the track. The tracks of conventional crossbows are either made of plastic and molded as part of the crossbow stock (e.g., plastic heat-injection molded) or made of aluminum via an extrusion process. Aluminum tracks provide less friction, but are more expensive and add undesired weight to the crossbow.

Figures 1, 2:
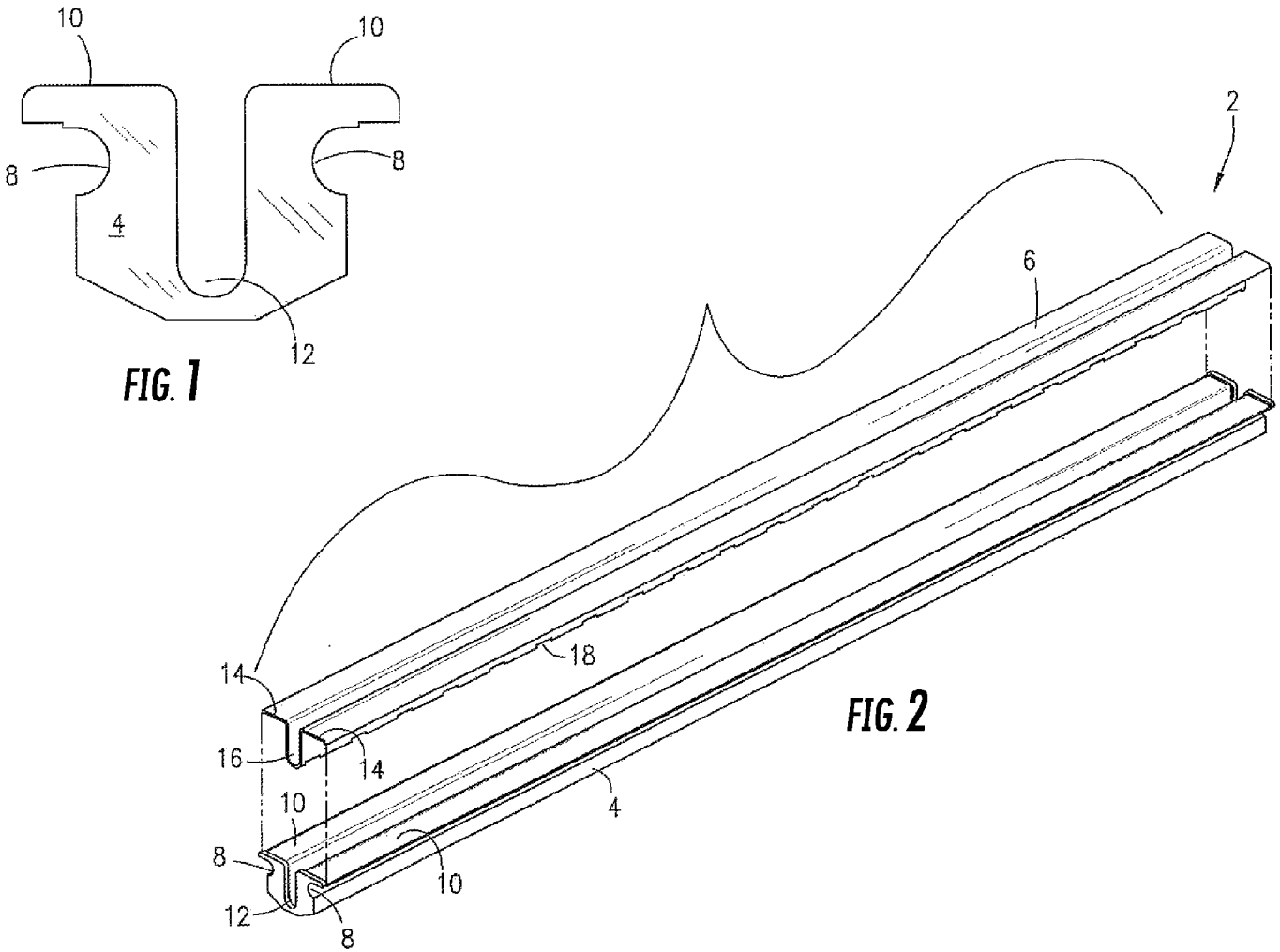
FIG. 1 is an end view of a base component of a flight track assembly for a crossbow stock.
FIG. 2 is an exploded perspective view of the flight track assembly.
Figure 3:
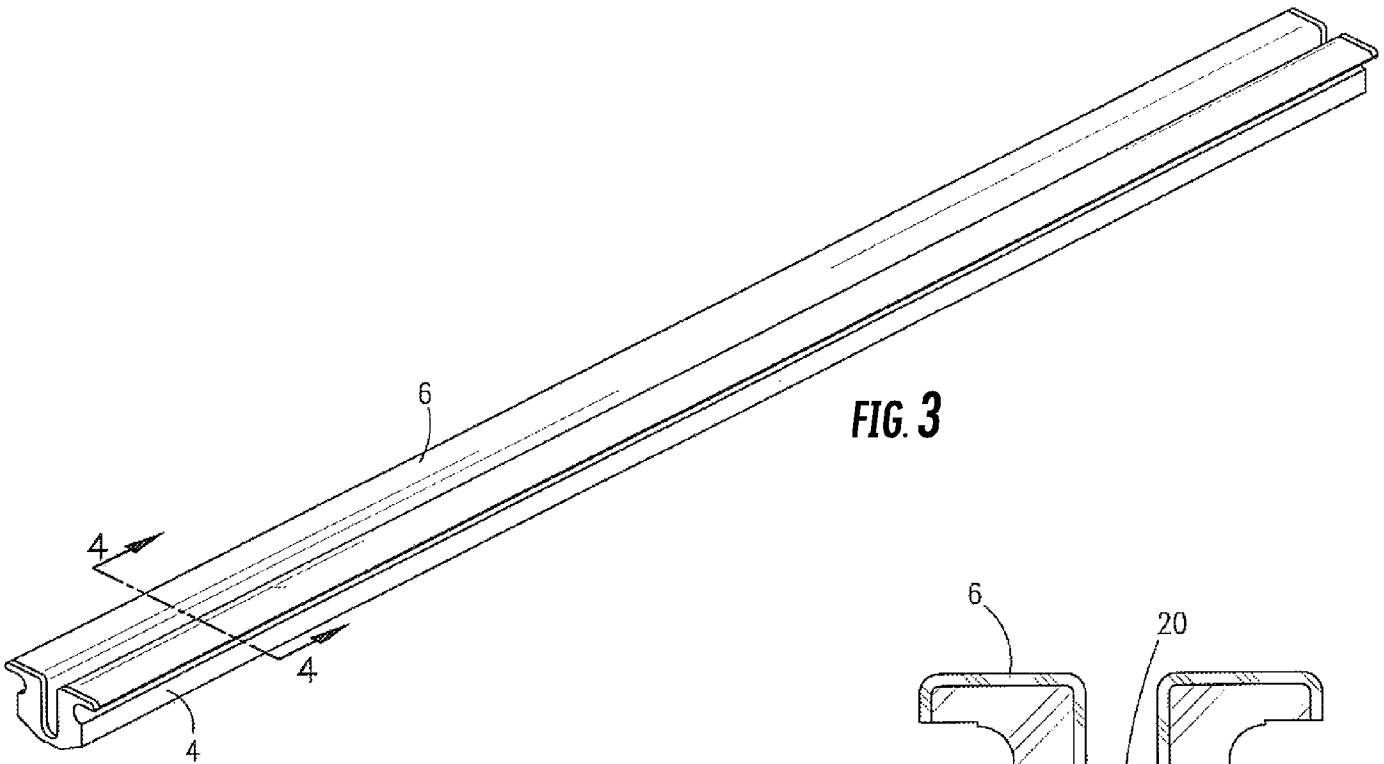
FIG. 3 is a perspective view of the flight track assembly of FIG. 2.

FIGS. 1 and 2 show flight track assembly 2 having base component 4 and flight track component 6. Base component 4 may have side profile 8, upper surfaces 10, and central channel 12. Flight track component 6 may include two winged portions 14 interconnected by central U-shaped portion 16. Flight track component 6 may also include series of recesses 18 through the apex area of central U-shaped portion 14. Flight track component 6 may fit above base component 4 as shown in FIG. 3. Specifically, winged portions 14 of flight track component 6 may fit onto upper surfaces 10 of base component 4, and central U-shaped portion 16 of flight track component 6 may fit into central channel 12 of base component 4. It is to be understood that base component 4 and flight track component 6 may be formed in many different shapes, in a variety of sizes, and of an assortment of compositions.

Base component 4 may be formed of a material capable of being molded. Base component 4 may be formed of a plastic material, a composite material, or a carbon material. Base component 4 may be made by a molding process such as heat-injection molding. Alternatively, base component 4 may include a rail formed of a metal that is dovetailed into the remainder of base component 4. The rail may be formed of aluminum.

Flight track component 6 may be formed of a metal such as aluminum or stainless steel. Alternatively, flight track component 6 may be formed of a ceramic material, a composite material, a plastic or polymer material, a carbon material, or any material capable of being molded. Alternatively, an upper surface of flight track component 6 may be formed of a low friction material. Flight track component 6 may be formed by a variety of processes such as extrusion, die-stamping, pultrusion, injection molding, or another molding process.

Figure 4:
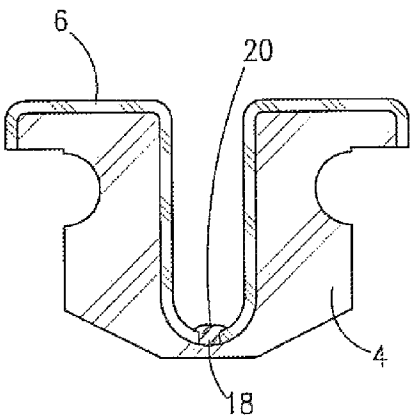
FIG. 4 is a cross-sectional view of the flight track assembly of FIG. 3 taken along line 4-4.

During a molding process for forming base component 4, flight track component 6 may be pressed onto base component 4 such that a portion of the material of base component 4 may extend through series of recesses 18. FIG. 4 shows portion 20 of base component material extending through recess 18 and overlapping a portion of flight track component 6. In this way, flight track component 6 may be secured to base component 4 to form flight track assembly 2. Alternatively, flight track component 6 may be pressed stamped into base component 4.

Figure 5:
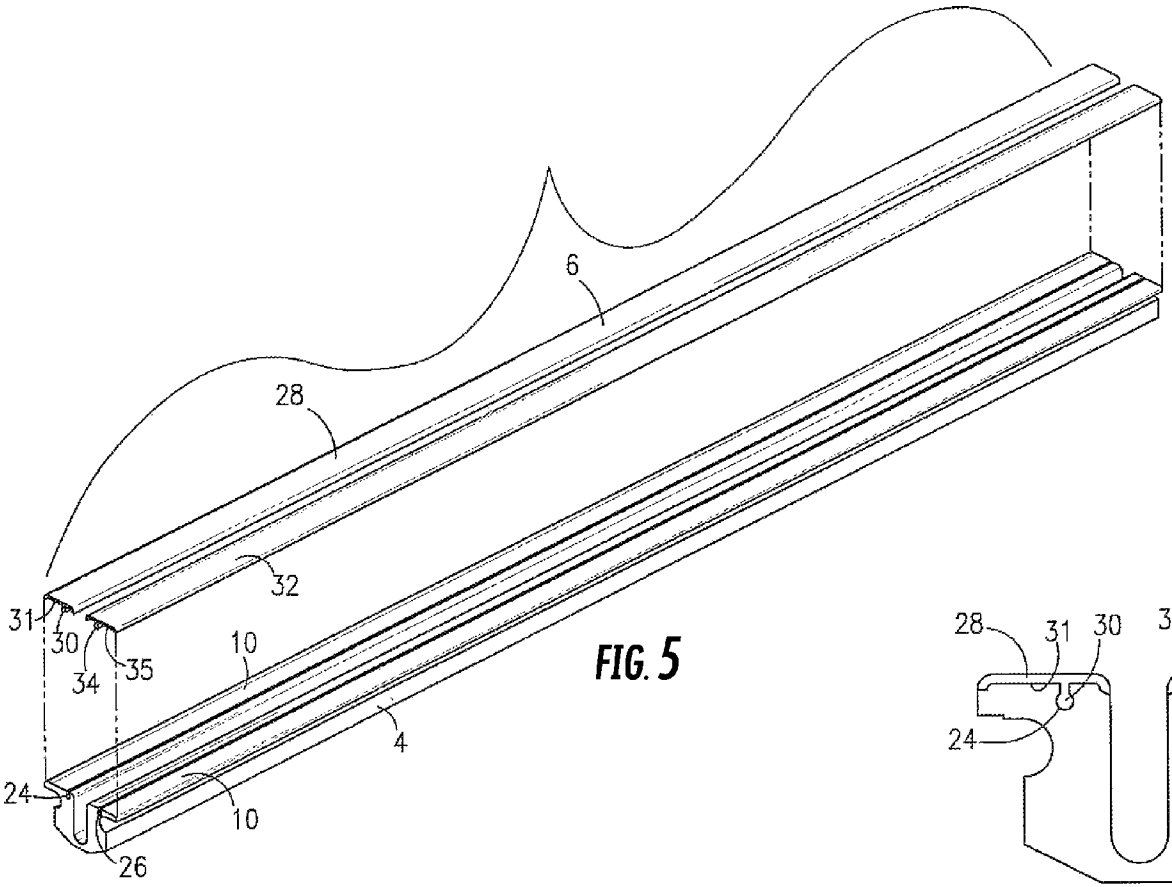
FIG. 5 is an exploded perspective view of an alternate embodiment of the flight track assembly.
Figure 6:
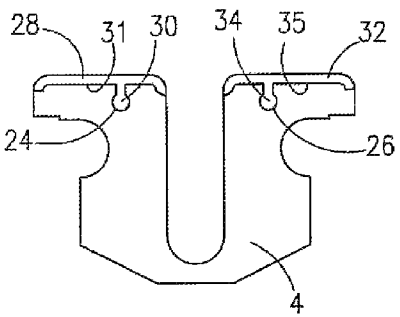
FIG. 6 is an end view of the flight track assembly of FIG. 5.

FIGS. 5 and 6 show an alternate embodiment of flight track assembly 2. Base component 4 may include recesses 24 and 26 in upper surfaces 10. Recesses 24 and 26 may extend the entire length of upper surfaces 10. Flight track component 6 may include rail 28 having projection 30 extending from lower surface 31 of rail 28. Flight track component 6 may also include rail 32 having projection 34 extending from lower surface 35 of rail 32. Projections 30 and 34 may extend the entire length of rails 28 and 32. Rail 28 may be secured to base component 4 by sliding projection 30 through recess 24. Similarly, rail 32 may be secured to base component 4 by sliding projection 34 through recess 26.

Figure 7:
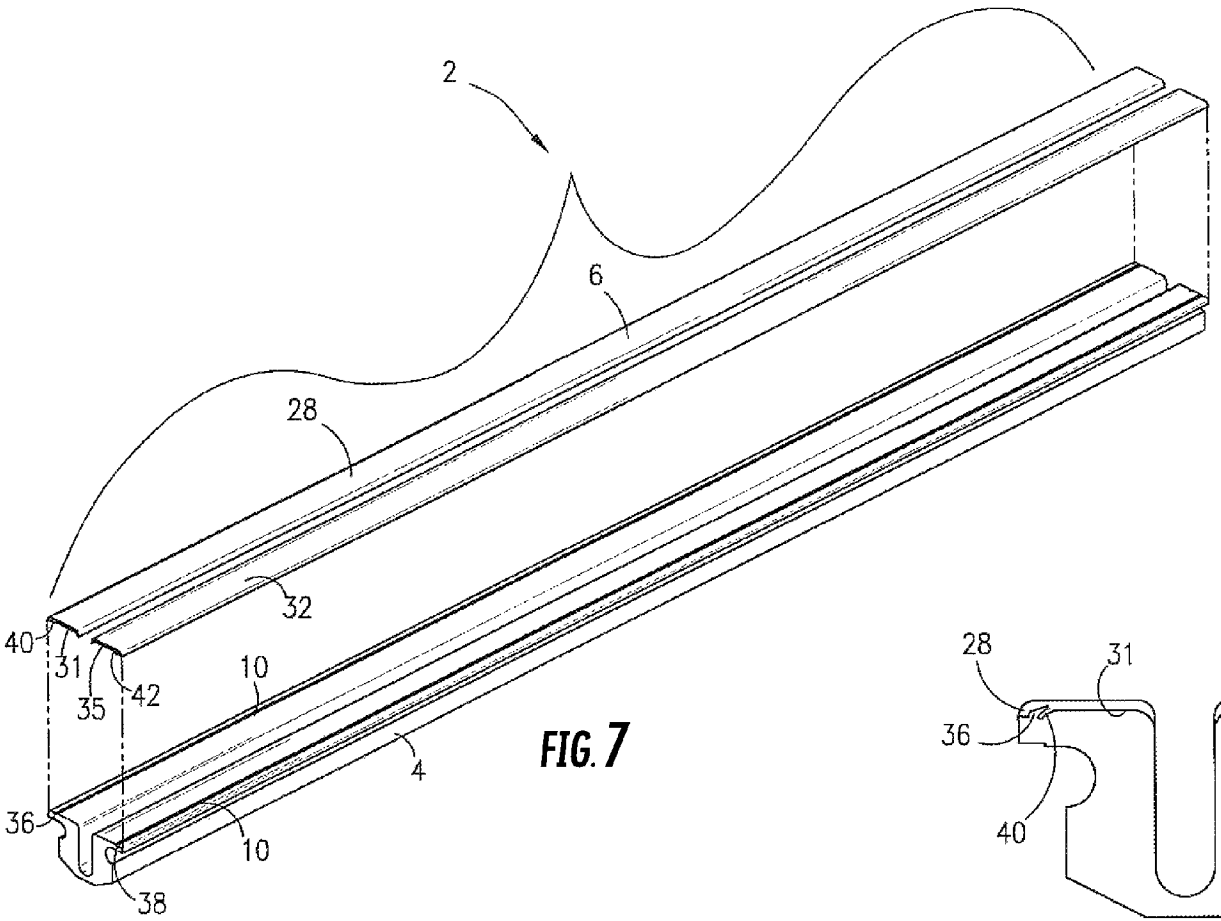
FIG. 7 is an exploded perspective view of another alternate embodiment of the flight track assembly.
Figure 8:
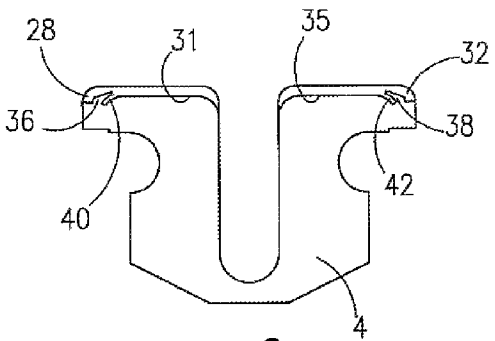
FIG. 8 is an end view of the flight track assembly of FIG. 7.

FIGS. 7 and 8 show another alternate embodiment of flight track assembly 2. In this embodiment, base component 4 may include projections 36 and 38 on upper surfaces 10. Projections 36 and 38 may extend the entire length of upper surfaces 10. Flight track component 6 may include rail 28 having projection 40 extending from lower surface 31 of rail 28. Flight track component may also include rail 32 having projection 42 extending from lower surface 35 of rail 32. Projections 40 and 42 may be L-shaped or C-shaped and may extend the entire length of rails 28 and 32. Rail 28 may be secured to base component 4 through the interaction of projection 40 of rail 28 and projection 36 of base component 4. Similarly, rail 32 may be secured to base component 4 through the interaction of projection 42 of rail 32 and projection 38 of base component 4.

Figure 9:
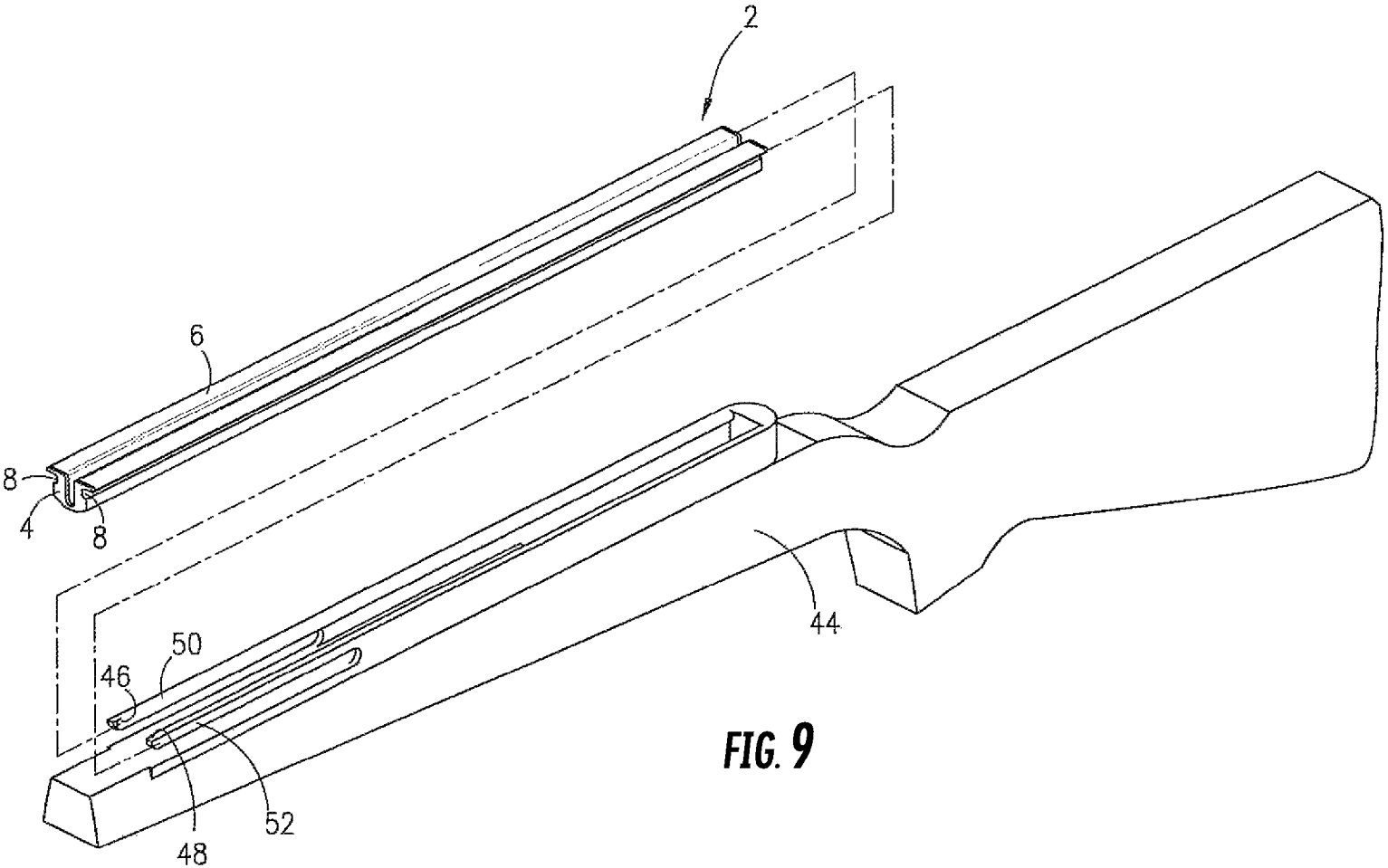
FIG. 9 is an exploded perspective view of the flight track assembly and a crossbow stock.
Figure 10:
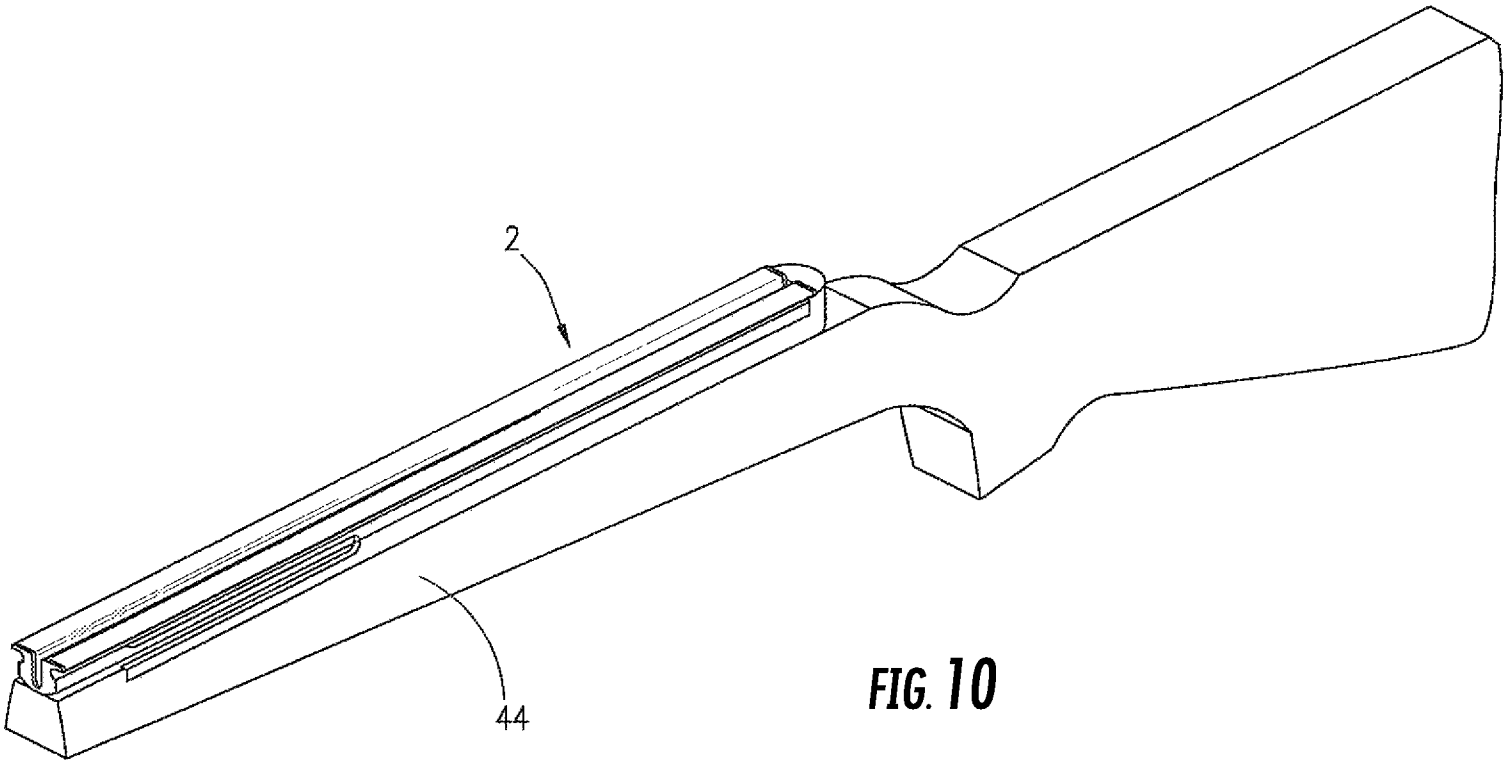
FIG. 10 is a perspective view of the flight track assembly attached to the crossbow stock.

FIGS. 9 and 10 illustrate a mechanism for attaching flight track assembly 2 to crossbow stock 44. Mating profiles 46 and 48 of stock rails 50 and 52 may be reciprocally shaped to side profile 8 of base component 4. Flight track assembly 2 may slide into stock rails 50 and 52 through the interaction of side profile 8 of base component 4 with mating profiles 46 and 48 of stock rails 50 and 52. In this way, flight track assembly 2 may be secured to crossbow stock 44.

Flight track assembly 2 may be secured to crossbow stock 44 in a number of alternative ways. For example, base component 4 may first be slidingly attached to stock rails 50 and 52 of crossbow stock 44 as described here, and flight track assembly 2 may then be attached to base component 4. In another embodiment, flight track assembly 2 may be secured to crossbow stock 44 by sealing, gluing, or mechanically attaching with a securing mechanism such as a screw, pin, or bolt.

In yet another example, base component 4 may be formed as an extension of crossbow stock 44 in a molding process for forming crossbow stock 44. In this embodiment, flight track component 6 may be attached to base component 4 in any of the ways described above for securing flight track component 6 to base component 4. Alternatively, in this embodiment, flight track component 6 may also be molded as part of the molding process of crossbow stock 44 and base component 4.

Figure 11:
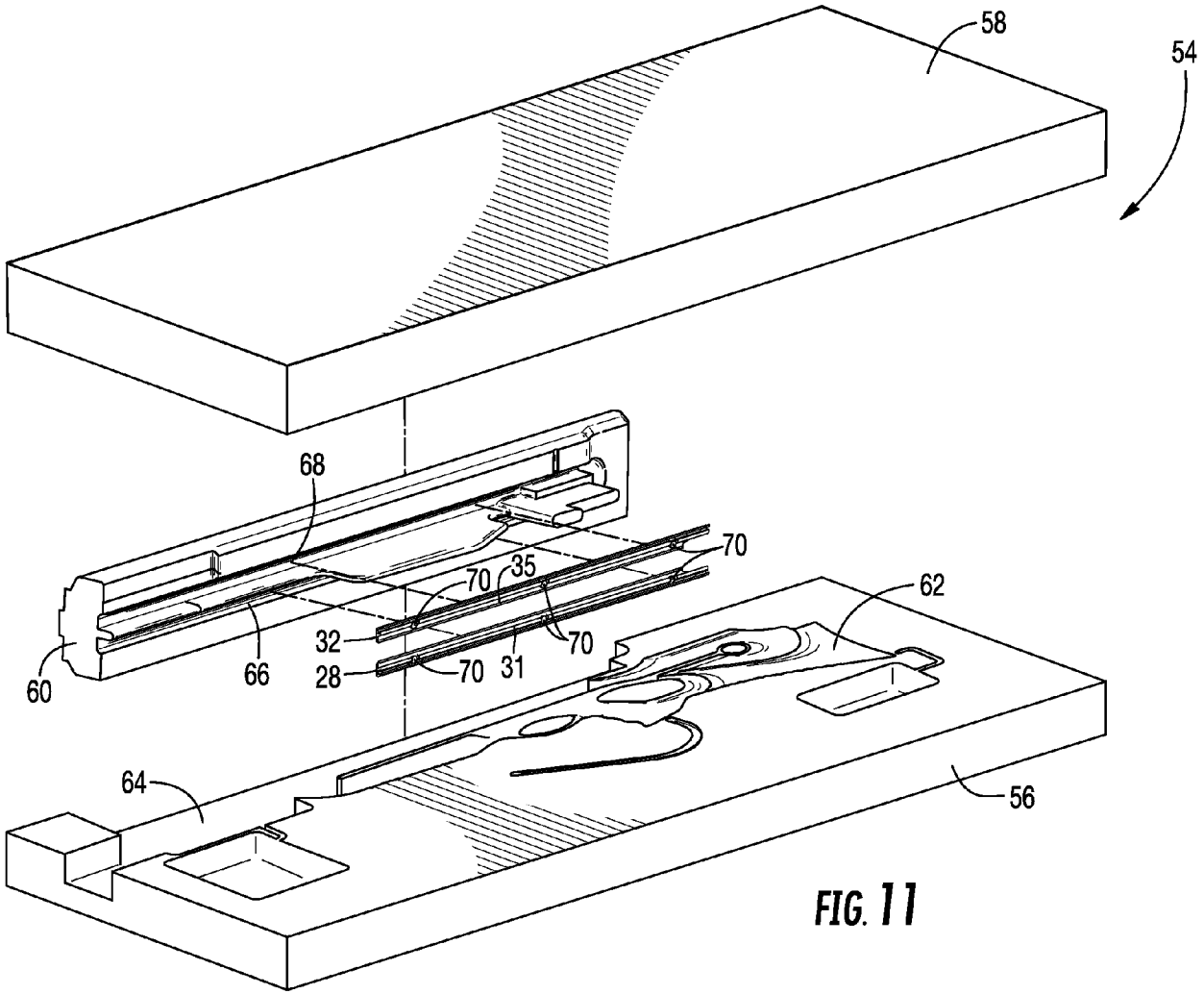
FIG. 11 is an exploded view of a mold assembly used to attach a flight track component of the flight track assembly to the base component during a molding process for forming the crossbow stock and the base component.

FIG. 11 illustrates mold assembly 54, which may be used to attach flight track component 6 to base component 4 during the molding process of crossbow stock 44 and base component 4. The use of mold assemblies in molding processes is well known, and is described in U.S. Pat. No. 7,007,445, issued to Louviere on Mar. 7, 2006, which is incorporated herein by reference. Mold assembly 54 may include first mold portion 56, second mold portion 58, and sliding core 60. First mold portion 56 may include crossbow stock cavity 62 and slide cavity 64. Second mold portion 58 may be shaped as a mirror image of first mold portion 56, and may include a crossbow stock cavity and a slide cavity (not shown). Sliding core 60 may include first groove 66 and second groove 68. Series of magnets 70 may be affixed to lower surface 31 of rail 28 and lower surface 35 of rail 32.

Rails 28 and 32 of flight track component 6 may be positioned in first and second grooves 66 and 68, respectively. Series of magnets 70 may secure rails 28 and 32 in first and second grooves 66 and 68. Alternatively, rails 28 and 32 may be secured in first and second grooves 66 and 68 by vacuum or suction. Sliding core 60 may be inserted into slide cavity 64 of first mold portion 56 and the slide cavity of second mold portion 58 such that rails 28 and 32 are positioned near crossbow stock cavity 62 and the crossbow stock cavity of second mold portion 58. First and second mold portions 56 and 58 may then be closed, and a material capable of being molded may be injected into crossbow stock cavity 62 to form crossbow stock 44. Base component 4 may be formed as an extension of crossbow stock cavity 62 in a portion of the space between crossbow stock cavity 62 and sliding core 60 and a portion of the space between the crossbow stock cavity in second mold portion 58 and sliding core 60, including rails 28 and 32. In this way, rails 28 and 32 are connected to base component 4 in the molding process used to form base component 4 and crossbow stock 44. After the molding process is complete, first and second mold portions 56 and 58 are separated from one another and sliding core 60. Rails 28 and 32 remain attached to base component 4 and crossbow stock 44 formed during the molding process. Series of magnets 70 remains between rails 28 and 32 and base component 4 as base component 4 is formed around series of magnets 70. In one embodiment, first mold portion 56 forms a first half of crossbow stock 44 and base component 4 while second mold portion 56 forms a second half of crossbow stock 44 and base component 4, and the first half and second half are attached to one another after the molding process. In this embodiment, flight track component 6 may be formed of aluminum, stainless steel, a composite material, a carbon material, or a plastic or polymer material.

Flight track assembly 2 described herein results in cost savings due to the use of an aluminum extruded or die-stamped flight track component as opposed to a flight track assembly made entirely of extruded or die-stamped aluminum. Flight track assembly 2 also weighs considerably less than conventional track assemblies formed entirely of aluminum. Crossbow stock 44 with flight track assembly 2 is also made more efficiently and quickly than conventional crossbow stocks.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A flight track assembly of a crossbow stock comprising:

a base component dimensioned to attach to an upper portion of the crossbow stock;

a flight track component disposed on an upper surface of said base component, said flight track component secured to said base component by an attachment mechanism, and wherein said flight track component includes two rails.

2. The flight track assembly of claim 1, wherein said flight track component is one continuous piece.

3. The flight track assembly of claim 1, wherein said base component is formed as one continuous piece with said crossbow stock.

4. The flight track assembly of claim 1, wherein said attachment mechanism comprises a projection extending from a lower surface of said flight track component and a reciprocally shaped recess in said upper surface of said base component, said projection designed to slide into said recess to secure said flight track component to said base component.

5. The flight track assembly of claim 1, wherein said attachment mechanism comprises a projection extending from a lower surface of said flight track component and a cooperating projection on said upper surface of said base component, said projection designed to engage said cooperating projection to secure said flight track component to said base component.

6. The flight track assembly of claim 5, wherein said projection comprises an L-shaped or C-shaped projection.

7. The flight track assembly of claim 1, wherein said attachment mechanism comprises a series of recesses through said flight track component, said series of recesses designed to attach said flight track component to said base component during a molding process in which said base component is formed by allowing a portion of a material forming said base component to overlap a portion of the flight track component.

8. The flight track assembly of claim 1, wherein said base component comprises a plastic material, a composite material, or a carbon material.

9. The flight track assembly of claim 1, wherein said base component comprises aluminum.

10. The flight track assembly of claim 1, wherein said base component is formed by a molding process.

11. The flight track assembly of claim 1, wherein said flight track component comprises aluminum, stainless steel, another metal, a ceramic material, or a composite material.

12. The flight track assembly of claim 1, wherein said flight track component is formed by extrusion, die-stamping, or pultrusion.

13. The flight track assembly of claim 1, wherein said flight track component comprises a material capable of being molded, and wherein said flight track component is formed by a molding process.

14. The flight track assembly of claim 1, wherein an upper surface of said flight track component comprises a low friction material.

15. A crossbow comprising:

a crossbow stock having an upper portion;

a flight track assembly having a base component and a flight track component, said base component operatively connected to said upper portion of said crossbow stock, wherein said flight track component is disposed on an upper surface of said base component and includes two rails, and wherein said flight track component is secured to said base component by an attachment mechanism.

16. The crossbow of claim 15, wherein said attachment mechanism comprises a projection extending from a lower surface of said flight track component and a reciprocally shaped recess in said upper surface of said base component, said projection designed to slide into said recess to secure said flight track component to said base component.

17. The crossbow of claim 15, wherein said attachment mechanism comprises a projection extending from a lower surface of said flight track component and a cooperating projection on said upper surface of said base component, said projection designed to engage said cooperating projection to secure said flight track component to said base component.

18. The crossbow of claim 15, wherein said attachment mechanism comprises a series of recesses through said flight track component, said series of recesses designed to attach said flight track component to said base component during a molding process in which said base component is formed by allowing a portion of a material forming said base component to overlap a portion of the flight track component.

19. A method of making a crossbow stock comprising the steps of:

a) forming a crossbow stock by a molding process;

b) attaching a base component of a flight track assembly to an upper portion of said crossbow stock; and c) attaching a flight track component of the flight track assembly to an upper surface of the base component, said flight track component including two rails.

20. The method of claim 19, wherein said base component is attached to said crossbow stock in step (b) by sealing, gluing, or mechanically attaching.

21. The method of claim 20, wherein said base component is mechanically attached to said crossbow stock in step (b) with a screw, a pin, or a bolt.

22. The method of claim 19, wherein said base component comprises a profile that slidingly engages with a mating profile in said upper portion of said crossbow stock, and wherein said base component is attached to said crossbow stock in step (b) by sliding said base component into said upper portion of said crossbow stock.

23. The method of claim 19, wherein step (b) comprises: forming said base component of said flight track assembly as an extension on said upper portion of said crossbow stock by said molding process of step (a).

24. The method of claim 23, wherein step (c) comprises: attaching said flight track component of said flight track assembly to said upper surface of said base component during said molding process of step (a).

25. The method of claim 24, wherein said flight track component comprises a plastic or polymer material.

26. The method of claim 24, wherein step (c) further comprises: before the molding process of step (a), securing said flight track component to a portion of a mold assembly used in said molding process of step (a).

27. The method of claim 26, wherein said flight track component is secured to said portion of said mold assembly by a series of magnets fixed to said flight track component.

28. The method of claim 26, wherein said flight track component is secured to said portion of said mold assembly by a vacuum.

* * * * *